US008922283B2

(12) United States Patent
Balet et al.

(10) Patent No.: US 8,922,283 B2
(45) Date of Patent: Dec. 30, 2014

(54) WRISTWATCH WITH ATOMIC OSCILLATOR

(75) Inventors: Laurent Balet, Grimisuat (CH); Jacques Haesler, Morat (CH); Steve Lecomte, Bernex (CH); David Ruffieux, Lugnorre (CH)

(73) Assignee: ROLEX S.A., Geneva (CH)

( * ) Notice: Subject to any disclaimer, the term of this patent is extended or adjusted under 35 U.S.C. 154(b) by 156 days.

(21) Appl. No.: 13/415,115

(22) Filed: Mar. 8, 2012

(65) Prior Publication Data

US 2012/0229222 A1 Sep. 13, 2012

(30) Foreign Application Priority Data

Mar. 9, 2011 (EP) ..... 11405232

(51) Int. Cl.
*H03L 7/26* (2006.01)
*G04F 5/14* (2006.01)

(52) U.S. Cl.
CPC ..... *G04F 5/14* (2013.01)
USPC ..... 331/3; 331/94.1; 968/712; 968/829; 968/854; 368/256

(58) Field of Classification Search
CPC ..... G04F 5/14
USPC ..... 331/3, 94.1; 968/712, 829, 854; 368/256
See application file for complete search history.

(56) References Cited

U.S. PATENT DOCUMENTS 5,881,026 A 3/1999 Baur et al.
6,806,784 B2 * 10/2004 Hollberg et al. ..... 331/94.1
7,077,562 B2 7/2006 Bourgeois et al.
7,391,273 B2 6/2008 Seki et al.
7,697,377 B2 4/2010 Agesawa et al.
2002/0163394 A1 11/2002 Hollberg et al.
2007/0076776 A1 * 4/2007 Lust et al. ..... 372/56
2009/0128820 A1 * 5/2009 Nomura ..... 356/437
2009/0256638 A1 * 10/2009 Rosenbluh et al. ..... 331/3
2010/0188081 A1 * 7/2010 Lammegger ..... 324/304

FOREIGN PATENT DOCUMENTS

EP 0886195 A1 12/1998
EP 1422436 A1 5/2004
EP 1852756 A1 11/2007
EP 1906271 A1 4/2008
WO 2008/125646 A1 10/2008
WO 2011/026252 A1 3/2011

OTHER PUBLICATIONS

Author: Natasa Vukicevic, Alexander S. Zibrov, Leo Hollberg, Fred L. Walls, John Kitching and Hugh G. Robinson Title: Compact Diode-Laser Based Rubidium Frequency Reference Publisher: IEEE Traansactions on Ultrasonics, Ferroelectrics, and Frequency control vol. 47, No. 5, Sep. 2000.*

European Search Report (ESR) of EP 11 40 5232, mailing date Aug. 18, 2011.

* cited by examiner

*Primary Examiner* — Arnold Kinkead
*Assistant Examiner* — Richard Tan
(74) *Attorney, Agent, or Firm* — Westerman, Hattori, Daniels & Adrian, LLP

(57) ABSTRACT

A wristwatch, which comprises an atomic oscillator comprising a system for detecting the beat frequencies obtained by the Raman effect.

14 Claims, 7 Drawing Sheets

WRISTWATCH WITH ATOMIC OSCILLATOR

INTRODUCTION

The present invention relates to a wristwatch comprising an atomic oscillator. It also relates to a method of transmitting a time reference signal for a wristwatch by an atomic oscillator.

BACKGROUND ART

The quest for precision is one of the driving forces for technical innovation in watchmaking. This precision is in great part determined by the performance of an oscillator, the oscillation frequency of which generates a time signal that determines the timebase exploited by the mechanism of a wristwatch for finally indicating the time on a display.

A first solution in the prior art consists of a mechanical oscillator, based on a flywheel, called a balance wheel, coupled to a spiral spring. The stability of a mechanical oscillator is of the order of one second per day, despite the efforts of innovation based on the choice of particular materials, as is described for example in the documents EP 0 886 195 and EP 1 422 436.

A second solution in the prior art consists of a quartz oscillator, which can achieve a precision of one second per month, or even one second per year using more complicated temperature-compensated devices in order to avoid any drift caused by temperature variations, as is described in document WO 2008/125646.

Finally, a third solution, which is relatively theoretical as it is tricky to carry out in practice, is envisioned in the documents EP 1 852 756 and EP 1 906 271 using an atomic oscillator, based on the known effect of coherent population trapping (CPT), which makes it possible to measure a light intensity transmitted through a mixture of atoms, such as cesium or rubidium atoms. In theory, this solution makes it possible to obtain an oscillator which is more precise than that of the first two solutions. However, these documents do not provide information about the specific construction of an atomic oscillator within a wristwatch. For example, the atomic oscillator is used intermittently without any explanation as to the specific stable implementation of such a principle. Nor is it specified how to achieve both consumption and volume compatible with implementation in a wristwatch.

SUMMARY OF THE INVENTION

Thus, the aim of the invention is to provide a wristwatch oscillator that makes it possible to achieve great precision, while respecting the severe constraints of a very restricted volume and low available power within a wristwatch.

For this purpose, the invention is based on a wristwatch that relies on a system for detecting the beat frequencies obtained by the Raman effect in order to obtain a time reference of great precision.

Aspects of the invention are more particularly defined by the claims.

BRIEF DESCRIPTION OF THE DRAWINGS

These objects, features and advantages of the present invention will be explained in detail in the following description of particular embodiments given by way of nonlimiting example in relation to the following figures.

DETAILED DESCRIPTION OF PARTICULAR EMBODIMENTS

The solution adopted is based on the use of an atomic oscillator based on the Raman effect, which relies on the irradiation of reference atoms at an optical resonance frequency which induces the emission of photons with an optical frequency shifted from the hyperfine frequency of the reference atoms. By combining the two resulting signals it is possible to obtain a detectable beat, the frequency of the signal of which serves as the timebase for the wristwatch.

Figure 1:
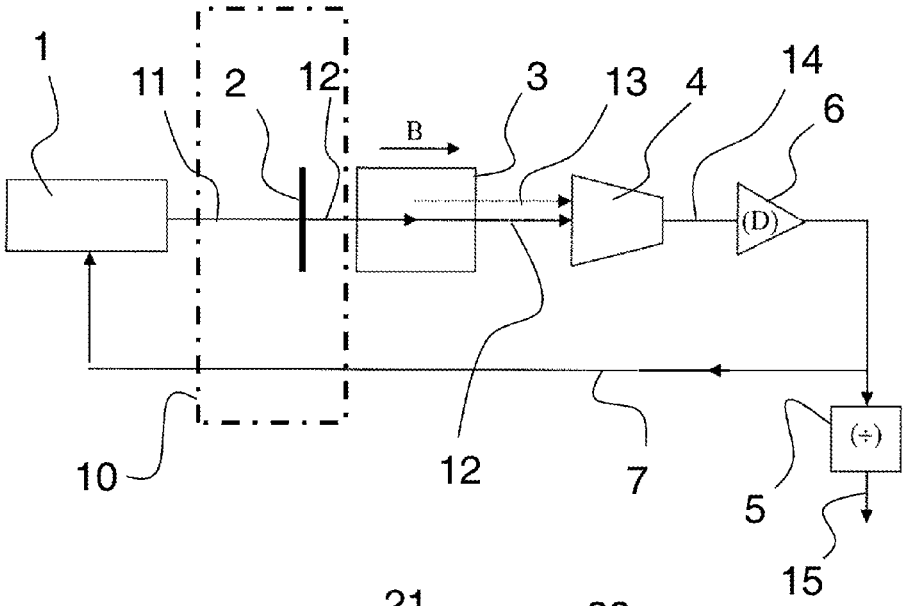
FIG. 1 shows a diagram illustrating the principle of a wristwatch atomic oscillator according to one embodiment of the invention.

FIG. 1 illustrates schematically the optical part of an atomic oscillator based on the Raman effect according to one embodiment of the invention. It comprises: a laser diode 1, which may be a VCSEL laser diode of low consumption, emitting a linearly polarized beam 11; and a quarter-wave plate 2 that polarizes the light coming from the laser according to an incident circularly polarized beam 12. This beam 12 passes through a cell 3 containing selected atoms, such as cesium or rubidium atoms, with a buffer gas, this cell being optionally placed in a magnetic field B. On leaving this cell 3, the incident signal 12 is combined with the second signal 13 generated by the Raman effect, as explained above. The combination of the two signals is detected by a photodetector 4 that makes it possible to recover the signal, comprising the atomic timebase, coming from the cesium or rubidium atoms. This output signal 14 is analyzed by an electronic signal processing device 5 of the microwave frequency divider type, in order to generate the frequency of the signal necessary for the timebase. The output 15 finally represents this timebase exploited by a wristwatch, as will be explained below. An optional radiofrequency amplifier 6 is positioned at the output of the photodetector 4.

Incidentally, part of the output signal 14 is optionally, but advantageously, used to modulate the laser injection current by microwave injection into the laser 1, this part of this signal being represented by the arrow 7. This arrangement makes it possible to achieve a signal-to-noise ratio at the output 14 which is of better quality and easier to exploit. This principle is equivalent to amplitude modulation of the laser.

It should be pointed out that the cell 3 has been positioned within a magnetic field B, thereby making it possible to lift the degeneracy of the Zeeman substates of the atoms. As a variant, the cell could be placed in a zero magnetic field, making it possible to superpose the energy levels, to obtain a high signal and a simplified oscillator.

Figure 2:
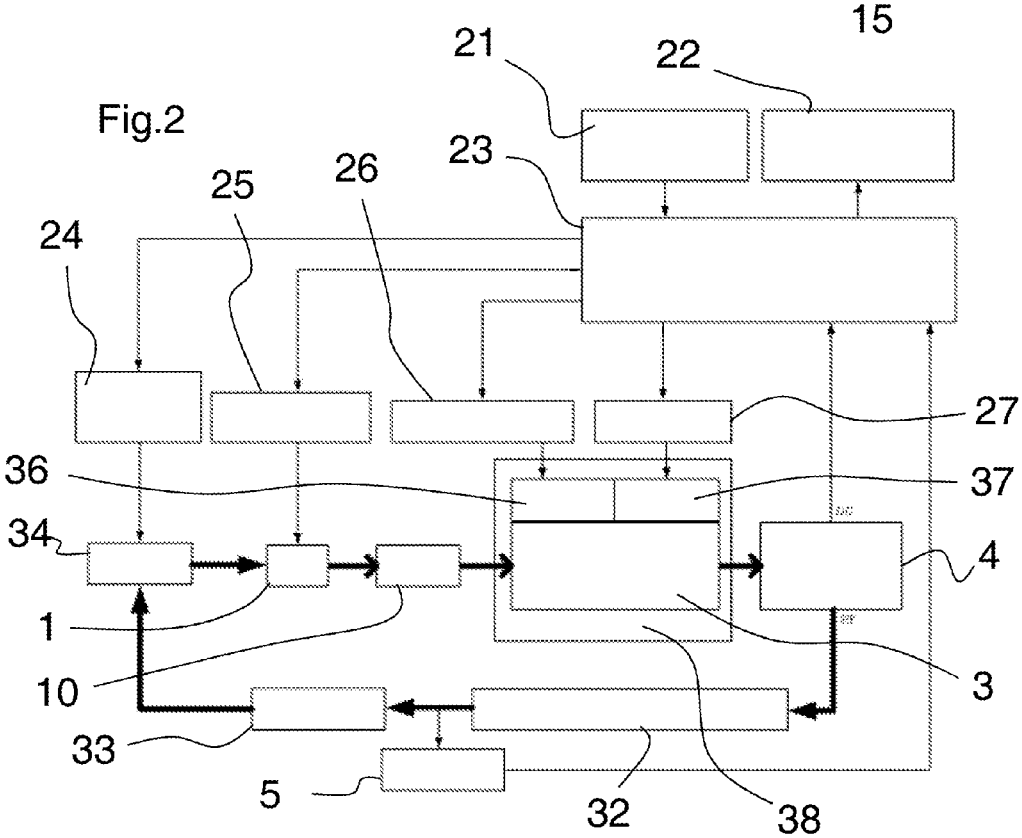
FIG. 2 shows a functional diagram of the wristwatch atomic oscillator according to one embodiment of the invention.

FIG. 2 shows functionally an atomic oscillator based on the Raman effect according to one embodiment of the invention. It comprises: a supply and DC/DC converter device 21; and a processing unit 23 which may be a low-power electronic device or processor, the main functions of which comprise all or some of the following functions: fixing the operating frequency of the laser 1 and the injection current thereof; controlling the temperature of the cell 3 and of the laser 1; managing the intermittent mode of the laser; temperature-correcting the frequency of the atomic oscillator; and setting an additional oscillator of lower precision, such as a quartz oscillator. The implementation of these functions will be explained in detail below. The oscillator then comprises: a DC current source 24 for the laser 1; a DC current source 25 for heating the laser 1; a current source 26 for the solenoid 36, in order to generate the magnetic field B; and a current source 27 for heating the cell 3, which cooperates with an associated heater 37 to which may also be added a temperature sensor.

These various components make it possible to operate the laser 1 that acts on the optical device 10 of the oscillator, a simplified representation of which has been shown with reference to FIG. 1. In this embodiment, the assembly formed by the generator 36 for generating the optional magnetic field B, the heater 37 and the cell 3 is positioned in a shielded enclosure 38, making it possible for these components to be magnetically shielded. As a variant, only some of these components may be incorporated within this shielded enclosure 38. As another variant, this magnetic field may be zero, and the oscillator may be simplified as explained above. On the output side, a high-speed photodetector 4 comprises a DC output for returning a signal proportional to the received light intensity to the processing unit 23. It also comprises an RF output for a signal which is firstly amplified by an amplification chain 32 and then a delay line and phase shifter 33, before being reinjected into a diplexer 34 (bias tee), which makes it possible to combine the RF signal with the DC laser injection current coming from the current source 24. Part of the RF signal amplified is processed by a frequency divider 5 before being returned to the processing unit 23. This processing unit delivers as output a signal 22 at the user frequency (for example 32 kHz or 1 pulse per second, etc.). Finally, this oscillator is produced from low-consumption components for implementation compatible with a wristwatch environment.

It should be noted that CPT-type atomic clocks all use a complex architecture and include a VCO (voltage-controlled oscillator), for correcting the local oscillator, and an electronic device for controlling the oscillator, representing in total a high power consumption. The atomic oscillator of the Raman type described above has the advantage of much greater simplicity for a greatly reduced power consumption.

In such an oscillator using the Raman effect, an incident laser beam at a first frequency interacts with an atomic vapor, thus stimulating, by light-atom interaction, the emission of a second beam having a second frequency through the Raman effect. As was mentioned, the beat between the first and second frequencies produces a third frequency, namely the beat frequency, which is used as timebase. In the case in which the vapor comprises for example rubidium 85 atoms and the laser is of the VCSEL (vertical-cavity surface-emitting semiconductor laser) type emitting a light beam at a wavelength lying in the region of 780 nm or 794 nm, the beat frequency is about 3 GHz with a bandwidth around one hundred kHz or so. This beat frequency is generally of very low level and has a very low spectral content. Detecting such a beat frequency output by the oscillator, to be used in a wristwatch, is a tricky technical problem, in particular for limiting the power consumption.

To solve this technical problem, a system for detecting a narrow-band signal ($i_{PD}$) of high frequency ($\omega_C$), having a low current consumption, is proposed. The system comprises a generator, for delivering the signal ($i_{PD}$) in the form of a current, and a parallel resonant circuit for varying the output impedance of the generator as a function of the frequency of the generated signal and for converting the current into a voltage. The system also includes an amplification stage for further increasing the gain, whilst minimally impairing the noise of the system, in order to be able to detect a signal of very low amplitude. The generator is the aforementioned photodetector 4 stimulated by electromagnetic radiation.

Figure 3:
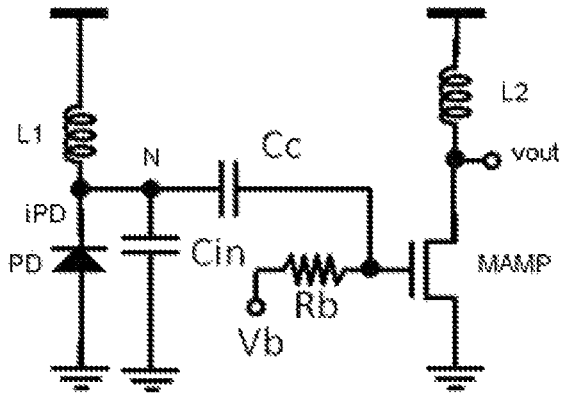
FIG. 3 shows the equivalent circuit diagram of an optoelectronic detection system according to one embodiment of the present invention.

According to one embodiment of the detection system, shown in FIG. 3, a simple inductor L1 is included in the construction of the parallel resonant circuit, and the photodetector is of the type comprising a photodiode PD. The photodiode PD is biased through the inductor L1 connected to a voltage source. This arrangement makes it possible to maintain the photodiode PD at a desired voltage, by supplying the necessary current in order for the photodiode PD to operate correctly. It should be noted that the signal to be detected has a spectral content centered around a predetermined frequency $\omega_C$ of the order of a few gigahertz, said spectral content being very narrow (of the order of $10^{-4}\ \omega_C$).

The signal $i_{PD}$ to be detected appears in the form of a current at a node N that connects the inductor L1 to the photodiode PD. This node N is electrically coupled to the input of the amplifier MAMP and the amplified signal appears at the output of the amplifier MAMP. The node N thus configured is therefore associated with a parasitic capacitor $C_{IN}$. This parasitic capacitor $C_{IN}$ together with the inductor L1 forms the parallel resonant circuit. The inductance of the inductor is determined so that its inductive reactance at the frequency of the signal to be detected is equal to the capacity reactance of the parasitic capacitor $C_{IN}$. In other words, $\omega_C$ L1$=1/(\omega_C\ C_{IN})$. These conditions result in a low-pass filter with a quality factor Q and a mid-height width of 1/Q. With an inductor L1 integrated into the circuit, an equality factor Q of about 10 is obtained, whereas with an inductor L1 external to the circuit a quality factor Q of about 50 is obtained. The equivalent parallel resistance Rp is equal to ωL Q. Thanks to a high quality factor Q, it is possible to achieve a high gain without the consumption that would normally be associated therewith. Without the present invention, a broadband transimpedance amplifier with a bandwidth of 10 GHz would be used instead of that proposed. Typically, this kind of amplifier consumes about one watt, whereas the amplifier proposed above consumes less than two milliwatts.

Figure 5:
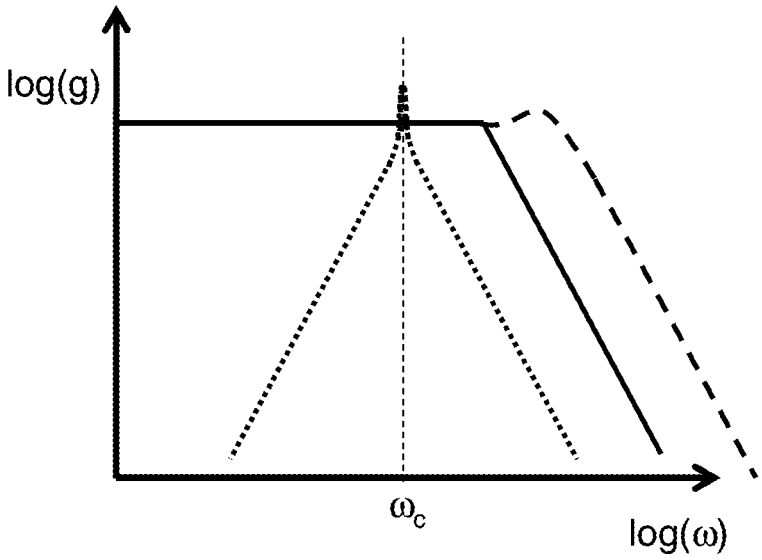
FIG. 5 shows schematically the curves of the gain g as a function of the frequency ω, the two axes being logarithmic, for a conventional transimpedance amplifier (solid curve), a transimpedance amplifier provided with an element for increasing the bandwidth ("inductor peaking" or "high-frequency gain boosting"; dashed curve) and a detection system according to the invention (dotted curve).

FIG. 5 shows clearly the difference in the gain as a function of the frequency for the two types of amplifier. A broadband transimpedance amplifier of the prior art makes it possible to cover a wide frequency range, but entails a high power consumption and a comparatively high noise level, given that the noise is higher the broader the bandwidth. Unlike the broadband transimpedance amplifier, the proposed solution selects, with a resonant element, a signal centered around a central frequency which is markedly lower than the typical cutoff frequency of the photodetector technology used. The gain characteristic shows a very narrow bandwidth, compatible with the narrow spectral content of the signal (of the order of $10^{-4}\ \omega_C$), thereby greatly reducing the noise compared with a transimpedance amplifier. The consumption is very low since the system does not include active elements.

Since the node N has a very high impedance, it is sufficient to use a simple MOS-type amplifier with a common low-noise source to further increase the gain, by minimizing the noise of the system, so as to enable a signal of very low amplitude to be detected. In one embodiment, the amplifier has a resistive load on the output. In another embodiment, profiting from the fact that the signal to be detected has a very narrow spectral content, which may be a single unmodulated frequency, the load at the output of the amplifier is provided by a second inductor L2, the inductance of which is chosen to maximize the gain for a signal at the predetermined frequency $\omega_C$.

The input of the amplifier may be coupled in AC mode to the node N, that is to say with a coupling capacitor CC, and the input of the amplifier may therefore be biased by a voltage source Vb through a resistor Rb so that the input of the amplifier is at an optimum voltage.

In the production of a circuit according to the present invention, it may happen that the capacitance of the parasitic capacitor $C_{IN}$ or the inductance of the inductor L1 varies from one batch to another or from one component to another. This would have the effect of shifting the resonance frequency of the resonant circuit to outside the frequency band suitable for detecting a signal at the predetermined frequency. For this reason, it is proposed to adjust the capacitance of the capacitor associated with the node N. This may be accomplished in various ways, for example by using a trimming capacitor or by using several capacitors that may be connected to or disconnected from the node N, for example by the targeted deposition of metal during fabrication. It may also be accomplished by a laser-trimming system in which the node N is connected to a capacitor, the capacitance of which is adjusted by laser ablation at the moment of testing the system.

Figure 4:
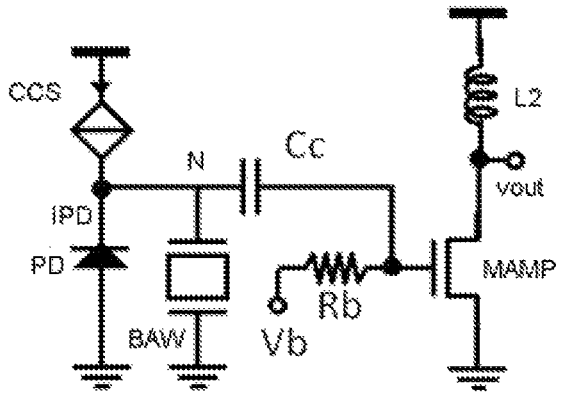
FIG. 4 shows the equivalent circuit diagram of an optoelectronic detector according to another embodiment of the present invention.

According to one embodiment of the present invention, the resonant circuit comprises an electromechanical resonator of the BAW (bulk acoustic wave) type as illustrated in FIG. 4. The BAW resonator provides even more selective filtering and has, at the antiresonance, a high real impedance, while still allowing the parasitic capacitance $C_{IN}$ associated with the node N to be neutralized. According to one embodiment, the electromechanical resonator makes it possible to achieve a Q of greater than 300. In this embodiment, the photodiode is biased using an adaptive circuit, the output stage of which is a current source CCS controlled so as to guarantee a fixed bias voltage on the low-frequency diode.

Another technical problem encountered when implementing the oscillator using the Raman effect within a wristwatch is to achieve sufficient stability, while allowing precise operation over a satisfactory time period. This problem is solved by the operation described above in relation to FIG. 1 and functionally represented by FIG. 2.

Feedback of the RF signal detected at the optical laser frequency, so as to control the emission frequency of the laser, is always recommended in the prior art for obtaining a stable high-precision atomic oscillator, in particular for atomic clocks of the CPT type. In the present case, it has been found that it is almost impossible to control the operation of the Raman oscillator repeatedly and reliably in closed-loop mode with respect to the optical frequency of the laser. Synchronous detection, for stabilizing the frequency of a laser, is not appropriate in the case of a Raman oscillator in closed-loop mode.

Surprisingly, it is possible to operate the Raman oscillator without optical frequency feedback control of the laser, that is to say with zero frequency feedback control, or in other words with no active control of the optical frequency of the laser, i.e. operation in open-loop mode with respect to the laser frequency.

Stability tests were carried out according to the above principle that demonstrated great stability. At a temperature of 87.5° C., the Raman oscillator will vary by one second every 160 years and operate in a stable manner for several days at least continuously.

The temperature of the cell, having an active length of 5 mm, was also lowered to below the melting point of rubidium (39.3° C.). Lowering the temperature from 90° C. to 35° C. corresponds to reducing the saturation vapor pressure by two orders of magnitude (~$10^{-4}$ torr to $10^{-6}$ torr). The stability depends on the temperature of the cell, but this remains acceptable up to a temperature of 35° C. This is because at a temperature of 40° C., the Raman oscillator still operates satisfactorily with a stability of one second every 16 years, something which is remarkable. At 35° C., the Raman signal is still present and sufficiently stable. This unexpected observation makes it possible to envision an atomic oscillator with no cell heating according to one embodiment, operating for example only when the temperature around the cell is high enough, for example around 35° C., preferably around 40° C. Thus, according to one embodiment, the atomic oscillator may operate at a temperature of 40° C. or below, or even 35° C. or below. It is also conceivable to reduce the operating temperature by using Cs instead of Rb in the cell, the melting point of cesium being even lower than that of rubidium (28.5° C. as opposed to 39.3° C.). Thus, a process for emitting a time signal within a wristwatch using an atomic oscillator may comprise a temperature feedback control, the operation thereof being maintained within the abovementioned temperature ranges, and/or a temperature-dependent correction of the time signal.

An additional technical problem is encountered when the oscillator is running. Specifically, the solution explained above shows how to obtain stable high-performance operation of the oscillator when it is in cruise mode on the basis of the devices described in relation to FIGS. 1 and 2. Operation entirely in open-loop mode, that is to say without the feedback 7 of FIG. 1, would be a conceivable alternative embodiment but of lower performance since the signal obtained would be relatively low and spectrally less pure.

To do so, it has been found that there is a reduced laser injection current range, i.e. a corresponding frequency range, close to the optical absorption peak of the gas in the cell, which makes it possible, when laser irradiation on the cell starts in open-loop mode, to switch thereafter to closed-loop mode as described above in order to make the oscillator resonate so as to achieve the optimum operating regime described above. Thus, by judiciously choosing the laser injection current upon priming the laser and then placing into closed-circuit mode with respect to the laser injection current as explained above, the oscillator naturally reaches its optimum operating regime. This phenomenon results in self-priming of the oscillator and enables it to be used intermittently.

Figure 6:
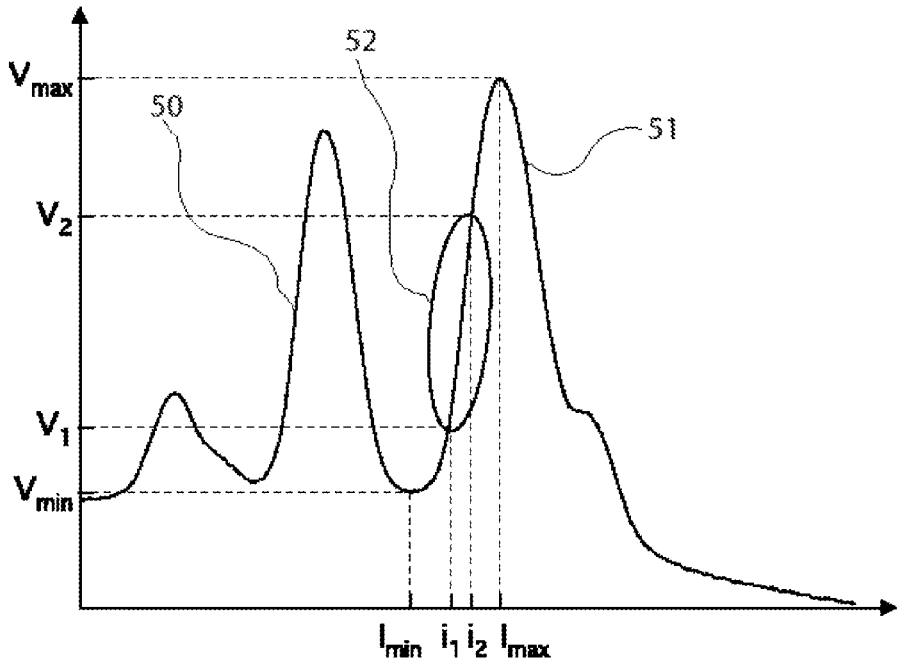
FIG. 6 shows the absorption spectrum of a gas as a function of the laser injection current scan with the atomic oscillator in open-loop mode.

This operating range is more precisely illustrated in FIG. 6 in the case of natural rubidium. FIG. 6 shows rubidium optical absorption curve 50, by way of the signal obtained on the photodiode 6, as a function of the laser injection current. The favorable current range is located in the region 52, which represents a portion of the highest absorption peak 51, and is some distance from the two maximum and minimum values $V_{max}$ and $V_{min}$ of this peak. By choosing a narrow range [$V_1$; $V_2$], sufficiently far from these maximum and minimum values, a favorable current range [$i_1$, $i_2$] is deduced therefrom.

The above considerations make it possible to implement the priming process using an oscillator for a wristwatch based on the Raman effect, which forms part of the process of emitting a time signal by an atomic oscillator according to the invention.

A first phase consists of seeking the optimum laser injection current i, that is to say the range from $i_1$ to $i_2$. This first phase comprises the following steps:

- placing the Raman-effect oscillator in open-loop mode;
- scanning the laser frequency and identifying the maximum absorption point $V_{max}$ and the corresponding injection current $I_{max}$, and also the minimum absorption point $V_{min}$ of the associated peak 51 and the corresponding injection current $I_{min}$; and
- determining an injection current ILD between $i_1$ and $i_2$ by adding a certain threshold value to $I_{min}$ or by subtracting this from $I_{max}$. For example, a value close to $i_1$ may be chosen.

To give an example, for rubidium and a VCSEL laser used for the experiments, the laser injection current must be chosen to be between 2.25760 mA and 2.25824 mA, with $V_1$ being 15% of $V_{max}$–$V_{min}$ above $V_{min}$ and V2 being at 67% of $V_{max}$–$V_{min}$ above $V_{min}$.

This first phase of the priming process may be carried out before each priming of the oscillator so as to obtain the greatest possible precision, thereby making it possible to modify the preceding values over time according to any drift of the device or of the measurement conditions. As a variant, this phase is carried out only once, in order to calibrate the device, and the data is stored so as to be used at each priming.

The priming process also implements the following steps for specifically priming the laser and the oscillator:

- placing the oscillator in closed-loop mode, by adding the feedback 7 explained above;
- adjusting the laser injection current to the value ILD identified by the first phase;
- verifying that the resonance phenomenon of the oscillator is obtained at the output; and
- in the case of nonresonance, slightly modifying the injection current ILD within the [$i_1$; $i_2$] range by a predefined increment and repeating this step until the phenomenon of resonance is obtained.

According to an advantageous method of implementation, this process includes a prior step of measuring the optical power of the laser, since the frequency of the oscillator may depend on the optical power interacting with the atoms. This operation may be carried out by measuring the optical power by means of a photodiode of the device and by comparing the photovoltage thus generated with a stable reference voltage source. By adjusting the laser injection current and the laser temperature, it is then possible to obtain the nominal optical power and nominal optical frequency of the oscillator. The process may include a step of adjusting the power of the laser.

According to another advantageous method of implementation, this process includes a prior step of setting the temperature of the gas cell and of the laser, since the operation of the oscillator depends on the temperature, as mentioned previously. There is a correlation between the frequency of the Raman oscillator in closed-loop form and the temperature of the cell. This property enables the frequency to be controlled during the phases of starting and stopping the oscillator, by a single temperature measurement.

Thus, depending on the embodiment chosen, the Raman oscillator includes a temperature feedback control loop. To do this, it includes a temperature sensor, which may be a photodiode, and a heater to increase the temperature if said photodiode is below a temperature setpoint.

The steps described above of the priming process are automatically controlled by the oscillator on the basis of the hardware and software means of the processing unit 23 mentioned above, especially under microprocessor control.

The above atomic oscillator is thus implemented within a wristwatch.

According to a first wristwatch embodiment, the Raman oscillator is used intermittently, to complement a conventional oscillator of the prior art, for example a quartz oscillator. In this embodiment, the atomic oscillator transmits a timebase, which sets the quartz oscillator, corrects it and enables the precision thereof to be greatly increased over time. This intermittent operation of the atomic oscillator has the advantage of controlled additional consumption compared with a conventional wristwatch. Since the priming of this oscillator is controlled by the process described above, the performance of this first implementation in a wristwatch is very high. The atomic oscillator priming period is chosen according to a compromise between power consumption and precision of the wristwatch: the more this oscillator is used, the more precise the clock becomes, but the higher the power consumption. When the additional oscillator of lower precision is corrected by the atomic oscillator, the latter is turned off.

According to a second wristwatch embodiment, the Raman oscillator is used by itself as a replacement for the usual conventional oscillator, as a single timebase, and therefore used for permanent operation. The highest precision is obtained in this embodiment, but at the expense of greater power consumption.

The atomic oscillator described above is also produced with a compact structure, facilitating the insertion thereof into a wristwatch. FIGS. 7 to 14 thus illustrate several embodiments of the optical part of the atomic oscillator, making it possible to achieve a volume compatible with integration into a wristwatch. To do so, all these embodiments are based on two passes of the laser beam through the cell, thereby making it possible to achieve a long total length of the laser beam in a small volume.

Figure 7:
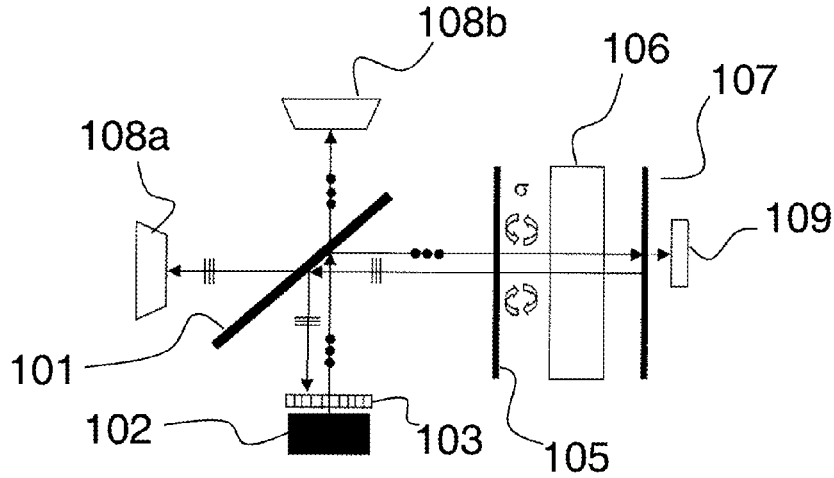
FIG. 7 shows a first embodiment of a two-pass atomic oscillator.
Figure 8:
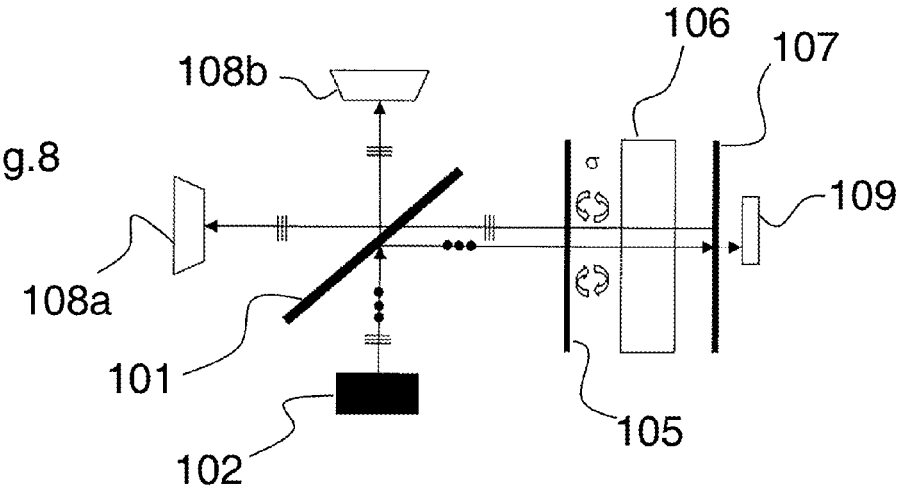
FIG. 8 shows a second embodiment of a two-pass atomic oscillator.
Figure 9:
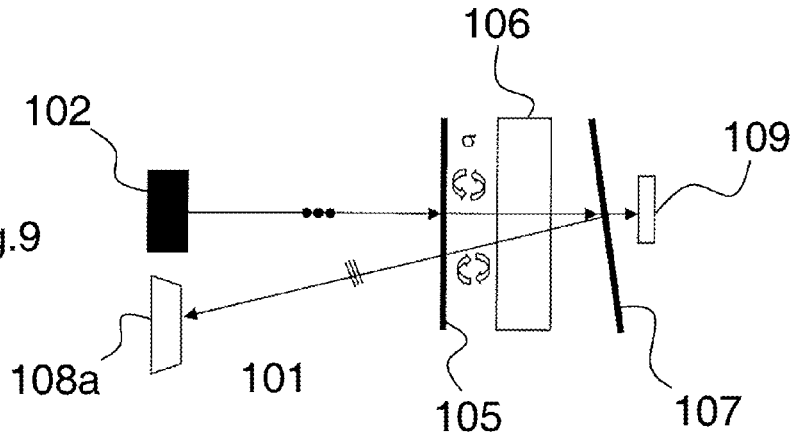
FIG. 9 shows a third embodiment of a two-pass atomic oscillator.

FIGS. 7 to 9 illustrate three different embodiments for simultaneously allowing two passes through the gas cell 106 and for protecting the laser source 102 from any reflections. One common point of these various embodiments is the presence of a semitransparent mirror 107 that lets through some of the laser beam that has passed through the gas cell 106 so as to reach the photodetector 109 serving for controlling the temperature of the cell. As a variant, these embodiments could be simplified by omitting the photodetector 109 and using a nontransparent mirror.

These three embodiments differ by the means used to direct the beam onto the cell and the photodetectors and by the means used to prevent the beam reflected by the mirror from interfering with the laser source.

FIG. 7 illustrates the first embodiment of the invention. The laser source 102 produces a linearly polarized laser beam which is directed onto a polarizer 103, the transmission axis of which is oriented so as to let the laser beam pass therethrough, and then onto a splitter 101 having a predefined splitting ratio. One part of the beam is thus transmitted to an optional photodetector 108*b*, while the splitter reflects the other part of the beam onto a quarter-wave plate 105. The linear polarization is denoted by "P" for the part parallel to the transmission axis of the polarizer (the transmitted part) and "S" denotes the part perpendicular to the transmission axis of the polarizer (i.e. the part absorbed by the polarizer). In the figures, the "P" part is shown symbolically by sets of three solid circles and the "S" part by sets of three short lines. The role of the plate 105 is to change the linear polarization of the laser beam into a circular polarization, this plate being oriented with respect to the polarizer so as to generate circular polarization. In fact, there is optimum interaction between the light and the atoms in the gas cell 106 when the light is produced by a circularly polarized beam. One part of the beam exiting the gas cell 106 is then reflected by a mirror 107, which reverses the direction of the circular polarization thereof and thus passes a second time through the gas cell 106. On exiting the gas cell 106, the beam reaches the quarter-wave plate 105. Depending on the predefined splitting ratio of the splitter 101, this beam is then partly transmitted and reaches the photodetector 108*a*. Another part of this beam is deflected by the splitter 101 and is greatly attenuated by the polarizer 103, since the polarization of the beam is perpendicular to that of the transmission axis of the polarizer 103, the laser source 102 thus being protected from back reflections. Another part of the beam that has passed through the gas cell 106 is transmitted by the mirror 107 and collected by the photodetector 109.

Figure 10:
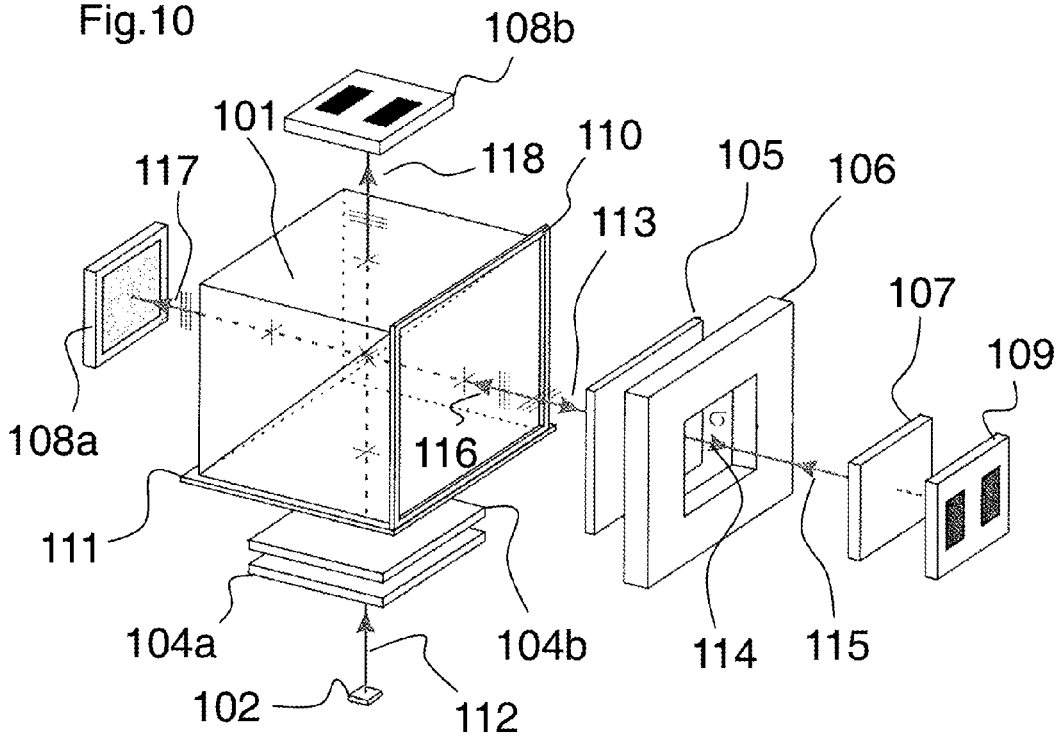
FIG. 10 shows a schematic exploded view of an atomic oscillator based on the second two-pass embodiment and a right-angled geometry.

FIG. 8 illustrates the second embodiment. This differs from the first embodiment described above by the use of a splitter 101 that reflects the beam in a first polarization and lets through the beam in a second polarization. Thus, the beam output by the laser source 102 is split according to the polarization thereof, and the same principle applies to the reflected beam. It is thus unnecessary to place a polarizer between the splitter 101 and the laser source because the reflected beam is entirely transmitted onto the photodetector 108*a*. The linear polarization is denoted by "P" for the part parallel to the polarization axis of the splitter (the part transmitted in the right-angled configuration of FIG. 8) and "S" denotes the part perpendicular to the polarization axis of the splitter (the part deflected through 90°). In FIG. 10, the "P" part is shown symbolically by three short lines and the "S" part by three solid circles. A small part of the beam that has passed through the gas cell 106 is transmitted by the mirror 107 and collected by the photodetector 109.

FIG. 9 illustrates the third embodiment of the invention. In this figure, the laser beam is deflected by the semitransparent mirror 107 which is placed at a nonperpendicular angle to the axis of the laser beam. Thus, the reflected beam does not reach the laser source 102 but is directed directly onto the photodetector 108*a*. Advantageously, the mirror 107 is of concave shape so as to focus the reflected light beam onto the photodetector 108*a*. A small part of the beam that has passed through the gas cell 106 is transmitted by the mirror 107 and collected by the photodetector 109. This concave shape of the mirror may also be used in the two embodiments shown in FIGS. 7 and 8, providing the advantages described above.

A more complete embodiment example corresponding to the second embodiment is illustrated in FIG. 10. The splitter 101 is in the form of a PBSC (polarizing beam splitter cube). This cube allows the beams to pass through the gas cell 106 twice, thereby increasing by a factor of two the interaction between the laser light and the atomic medium. This results in a better atomic signal and thus better frequency stability of the atomic oscillator.

In FIG. 10, the optical assembly is based on a miniature splitter cube 101, the sides of which preferably are 1 mm or smaller, the cube 101 acting as splitter. According to a standard embodiment, the splitter volume of the cube is typically 1 $mm^3$. The light beam from the laser diode 102 arrives on one of the sides of the cube 101. According to one embodiment, the laser diode is a VCSEL laser diode emitting a divergent light beam at 795 nm. In other embodiments, other types of laser diode having wavelengths typically varying from 780 nm to 894 nm may be used for a gas cell 106 containing rubidium or cesium. This choice is dictated by the atomic composition of the gas cell. According to one embodiment, a collimating lens may be added in front of the laser diode to produce a nondivergent laser beam.

According to a standard embodiment, the light 112 produced by the laser 102 is linearly polarized and attenuated by a neutral absorbent filter 104*a*. A different type of filter may be used in other embodiments. The presence of this filter is not necessary for the invention. A half-wave plate 104*b* may be used to modify the angle of the linear polarization of the laser source. In combination with the miniature splitter cube 101, the half-wave plate 104*b* acts as a variable attenuator. In other embodiments, the use of the half-wave plate 104*b* may be omitted and the ratio of the light intensities of the beams transmitted and reflected by the splitter cube 101 is adjusted by an appropriate orientation of the linear polarization axis of the light emitted by the laser relative to the splitter cube. A quarter-wave plate 105 is placed on the output side of the splitter cube against that face from which the laser beam deflected by the splitter 101 is output, i.e. at right angles to the beam incident on the splitter cube. The fast axis of the quarter-wave plate 105 is oriented in such a way that the incident linear polarization 113 is modified to a circular polarization 114 in a first rotation direction. In other embodiments, the quarter-wave plate 105 is oriented in such a way that the incident linear polarization 113 is modified to a circular polarization in a rotation direction the reverse of the first. The circularly polarized laser beam 114 passes through the gas cell 106 and reaches the mirror 107. The latter reflects the beam only partially and part of the beam passes through the mirror 107 to be directed onto the photodetector 109. According to a standard embodiment, the gas cell is made of glass-silicon-glass by MEMS (microelectromechanical system) techniques with an internal volume of typically 1 $mm^3$ and filled with an absorbent medium of the alkali metal (rubidium or cesium) atomic vapor type and a buffer gas mixture. According to a standard embodiment, the gas cell is filled with natural rubidium and a nitrogen/argon mixture as buffer gas. In other embodiments, other types of cell may be filled with different buffer gases. According to one particular embodiment, a miniature cylindrical cell may be used. In another particular embodiment, the gas cell may be integrated into the PBSC 101. The cell 106 may be filled with other types of alkali metal vapor (rubidium 85, rubidium 87 or cesium 133 for example) and other types of buffer gas (Xe or Ne for example).

Figure 11:
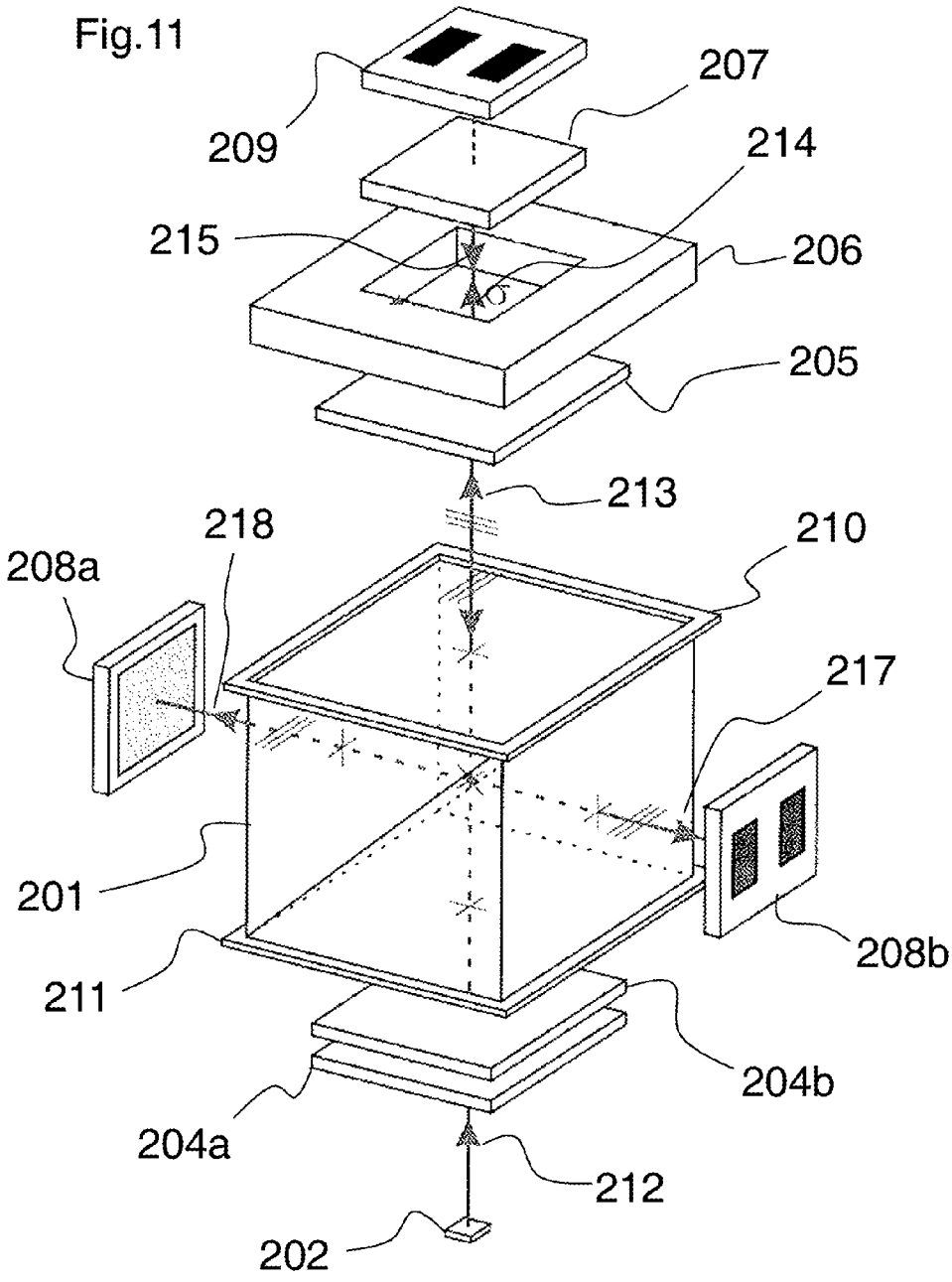
FIG. 11 shows a schematic exploded view of an atomic oscillator based on the second two-pass embodiment and a straight geometry.

FIG. 11 illustrates an optical two-pass design based on the second embodiment corresponding to FIG. 8, with a strict geometry very similar to the right-angled two-pass design shown in FIG. 10. The main difference lies in the position of the "gas cell 206, quarter-wave plate 205, semitransparent mirror 207 and photodetector 209" entity and of the photodetector 208*b*. In the model shown in FIG. 11, the gas cell 206 is placed above the PBSC 201 and therefore located on the opposite side from the laser 202. In this way, the light beam 213 of P polarization transmitted by the PBSC and then modified into a circularly polarized beam by the quarter-wave plate 205 interacts with the atomic medium. The light beam 217 of S polarization is reflected by the PBSC 201 and the photodetector 208*b*, placed at right angles, is used to measure the laser power. Apart from these differences, the operating principle of this embodiment is the same as that for the preceding model.

Figure 12:
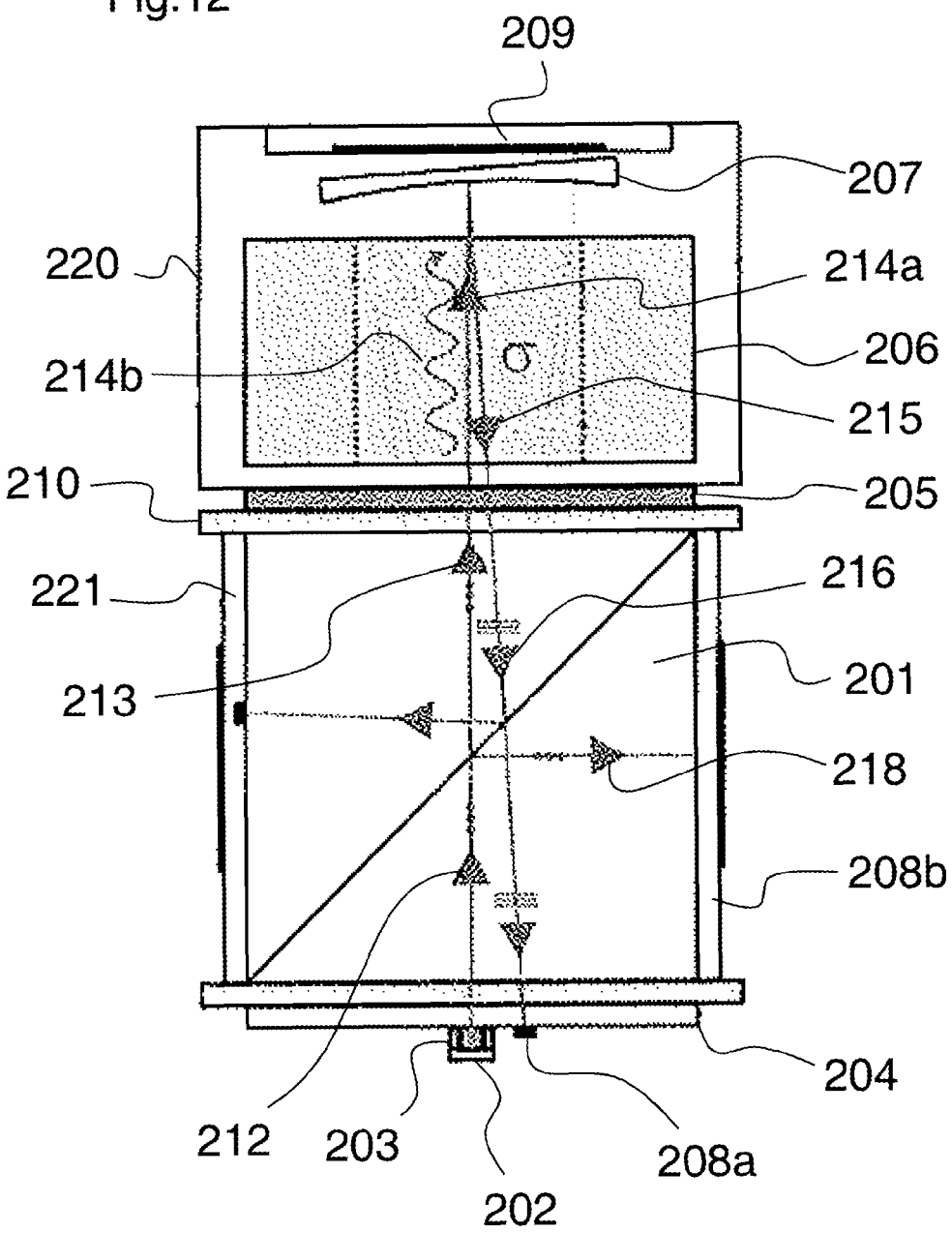
FIG. 12 shows a schematic view of an atomic oscillator based on the first two-pass embodiment.

FIG. 12 illustrates a schematic representation of the two-pass module of right-angled geometry of the embodiment of the Raman oscillator according to the first embodiment corresponding to FIG. 7. The numerical references start at 201 with this design, the same elements as those used in FIGS. 7 to 9 having numbers increased by one hundred. A splitter cube 201, the splitting ratio of which is predefined so as to have a minor reflection and a major transmission, of around 2% and 98% respectively (+/−2%), is used. The backreflected beam 216 is then predominantly deflected onto the photodetector 208*a*. In this embodiment, the gas cell entity 206 is placed above the splitter cube 201 and is therefore located on the opposite side from the laser 202. The photodetector 208*b* is placed at right angles, hence the light beam 212 emitted by the laser 202 is reflected 218 by the splitter cube 201 and is used for example to measure the laser power. The operating principle of this design remains similar to the previous descriptions.

Figure 13:
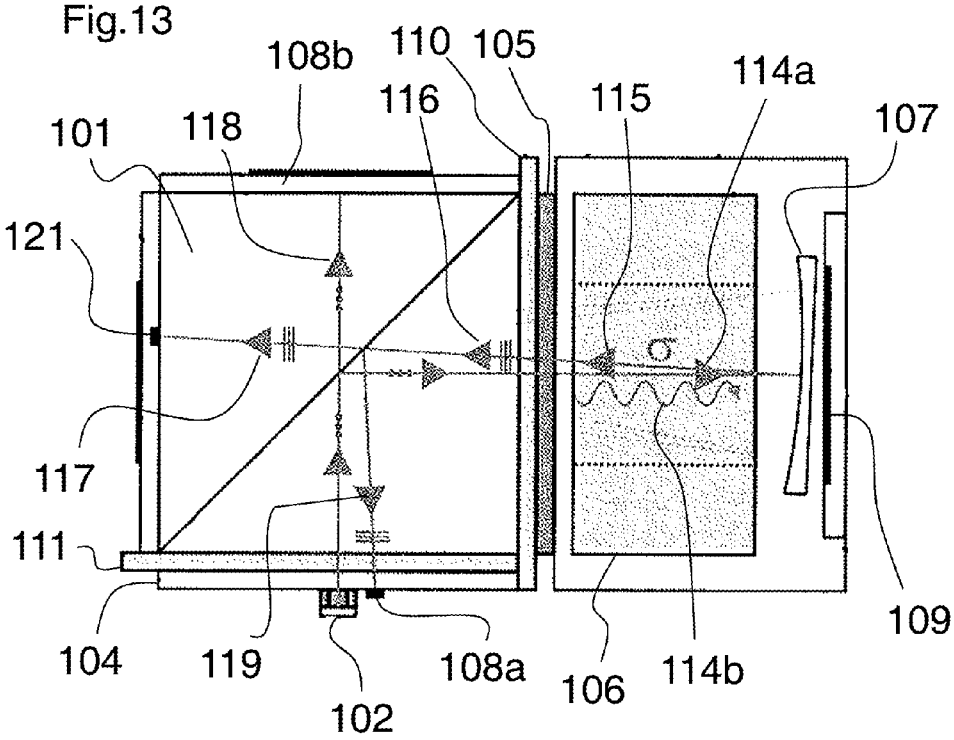
FIG. 13 shows a schematic view of an atomic oscillator based on the first two-pass embodiment with a right-angled geometry.

FIG. 13 illustrates a device according to the first embodiment with a right-angled geometry. The splitting ratio of the splitter 101 is predefined so as to have a minor transmission and a major reflection of about 2% and 98% respectively (+/−2%). After their interaction with the alkali metal vapor atoms, the incident light beam 114*a* and the light beam generated by stimulated Raman scattering (called the Raman beam) 114*b* are reflected by a mirror 107. In a standard Raman embodiment, the mirror 107 is coated with silver, is inclined (typically by 2 to 20°) and/or off-center with respect to its axis of symmetry and the axis defined by the incident laser beam, and is concave with a focal length chosen so as to focus the backreflected light beams 115 (incident and Raman beams) onto the photodetector 108*a*. The mirror 107 has a typical light transmission of a few percent. This transmitted light reaching the surface of the photodetector 109 is used to measure the absorption spectrum. In a different Raman embodiment, the output window of the gas cell 106 is concave, is coated with silver (or with another metal, such as for example gold) and acts as a reflector. In other embodiments, the output window of the mirror may be coated with dielectric films.

The backreflected (incident and Raman) light beams 115 pass through and interact a second time with the atomic medium (two-pass arrangement). The quarter-wave plate 105 converts these circularly polarized light beams into linearly polarized light beams 116. These (incident and Raman) light beams 119 are predominantly reflected and reach the first photodetector 108*a*, which records the beat frequency between the incident beam and the Raman beam. In a standard Raman embodiment, the first photodetector 108*a* is a high-speed semiconductor (silicon or gallium arsenide) photodetector which is positioned at the focus of the concave mirror 107. In other Raman embodiments, various types of high-speed photodetector may be used. The second photodetector 108*b* records the light 118 coming directly from the laser 102 and initially transmitted by the miniature splitter cube 101. In this way, the output power of the laser diode 102 may be measured and regulated. As an option, the photodetector 121 records the backreflected beam 117 transmitted by the splitter 101. The diaphragms 110 and 111 are used to prevent undesirable light from reaching the photodetectors if their dimensions are greater than those of the miniature splitter cube 101.

Figure 14:
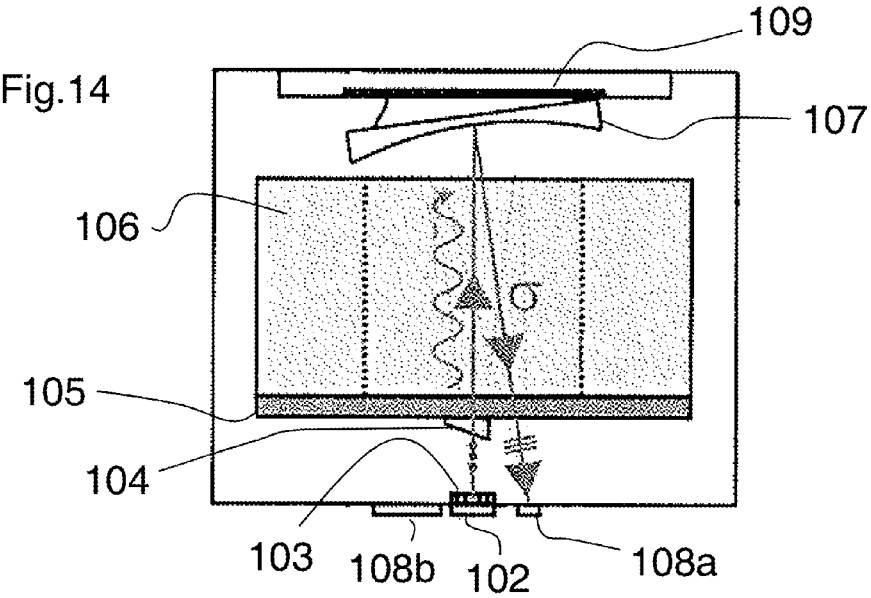
FIG. 14 shows a schematic view of an atomic oscillator based on the third two-pass embodiment.

FIG. 14 illustrates the third embodiment of the Raman oscillator, not based on a splitter cube but on a simple double-pass geometry. The light emitted by the laser source 102 is linearly polarized, converted to circular polarization by a quarter-wave plate 105 before passing through the cell 106, being reflected off the mirror 107, passing a second time through the cell, and detected on a first photodetector 108*a*. The mirror 107 is semitransparent, with a second photodetector 109 placed behind the mirror.

This use of the semitransparent mirror 107 makes it possible for the light that has interacted with the atoms of the cell to be detected by the photodetector 109. To prevent the beams backreflected by the mirror from interfering with the laser source 102, it is also advantageous to place a polarizer 103 in front of the laser source 102, and with a transmission axis parallel to the polarization of the beam emitted by the laser source 102.

As an option, the following elements may also be used:

- a neutral filter 104 placed between the laser source 102 and the quarter-wave plate 105 so as to adjust the power of the laser beam;
- an inclined reflective filter 104 placed between the laser source 102 and the quarter-wave plate 105 so as to reflect part of the laser beam and to adjust the power thereof;
- a third photodetector 108*b* placed so as to record the light reflected by the inclined reflective filter 104 for controlling the optical power of the laser 102.

It should be noted that, in these embodiments described in relation to FIGS. 7 to 14, the photodetector 108*a*, 208*a* has the function of detecting the beating induced by the Raman effect of the gas present in the cell 106, 206, and is therefore a photodetector suitable for detecting microwaves. The first photodetector 108*a* has a very narrow bandwidth centered around the resonance frequency of the atom so as to maximize the signal detection efficiency thereof. The high atomic resonance frequency (typically >1 GHz) would mean having a photodetector 108*a* of small size. Such a specification is not compatible with detecting the signal that has interacted with the atoms of the cell in order to adjust for example the temperature of the cell, which is implemented by the photodetector 109, 209 and/or the photodetector 108*b*, 208*b*. For the latter case, a low cutoff frequency (typically <100 kHz), or even a DC operation, is indicated. This is why it is preferable to have at least two detectors, one 108*a* serving to detect the clock signal and the other 109 to control the temperature of the cell. The ideal means for carrying out this second detection of a signal that has interacted with the atoms of the cell is to use a semitransparent mirror 107 for the reflection and to place a photodetector 109, such as that illustrated, behind this mirror. It is also advantageous for the mirror 107 to be of concave shape, as illustrated in FIG. 14, the concave shape being intended to focus the reflected light beam onto the photodetector 108*a*. It should be pointed out that the latter photodetectors are optional.

The invention claimed is:

1. A wristwatch, which comprises:

an atomic oscillator comprising a system for detecting beat frequencies obtained by Raman effect, wherein the atomic oscillator comprises a laser source, a cell containing cesium or rubidium and placed so as to receive a laser beam emitted from the laser source, and a beat frequency detection system that comprises a photodetector and an amplifier, which is placed so as to receive a laser beam output by the cell in order to detect a beat frequency obtained between the laser beam output by the laser source and transmitted through the cell and a laser beam induced by Raman effect within atoms in the cell, and a current source providing a laser injection current for the laser source of the atomic oscillator, a diplexer and a return link from the beat frequency detection system to the diplexer that allows a signal detected by the beat frequency detection system to be combined with the current source of the laser injection current, wherein the return link from the beat frequency detection system to the diplexer includes a phase shifter, wherein the beat frequency detection system is a system for detecting a signal $i_{PD}$ corresponding to the beat frequencies induced by Raman effect, with a narrow spectral content centered around a central frequency $\omega_C$, comprising at least a first inductive element L1 which is connected to the photodetector and a parasitic capacitor $C_{IN}$ parallel to the photodetector, together forming a resonant circuit for selecting the signal to be detected, said resonant circuit having a resonant frequency that corresponds to the central frequency $\omega_C$.

2. The wristwatch as claimed in claim 1, which includes an additional oscillator of lower precision, wherein the atomic oscillator operates intermittently so as to adjust the additional oscillator.

3. The wristwatch as claimed in claim 1, wherein the atomic oscillator includes no control of a frequency of the laser source.

4. The wristwatch as claimed in claim 1, which comprises at least one mirror for reflecting the laser beam and enabling the laser beam to undergo at least a second pass through the cell before reaching the beat frequency detection system.

5. The wristwatch as claimed in claim 1, which includes a shielded enclosure in which the cell is placed so as to allow operation with a zero magnetic field in said cell.

6. The wristwatch as claimed in claim 1, which includes a heater.

7. A process for emitting a time signal within a wristwatch by an atomic oscillator, which includes:

a step of detecting beat frequencies obtained by Raman effect, including a. sending a laser beam output by a laser source through a cell; and b. detecting, with a photodetector, a beat frequency obtained between a laser beam output by the laser source and transmitted through the cell and a laser beam induced by Raman effect within atoms of the cell, and a step of returning a microwave signal received as output by the photodetector onto a laser injection current via a phase shifter, wherein the process includes a process for priming the atomic oscillator, comprising:

a first phase of finding an optimum laser injection current in open-loop mode of the atomic oscillator and a second phase of priming the atomic oscillator comprising operating the atomic oscillator in closed-loop mode by returning the microwave signal received as output from the cell to the laser injection current, wherein the first phase of finding the optimum laser injection current comprises the following steps:

placing the atomic oscillator in open-loop mode;

scanning a laser frequency and identifying a maximum absorption point $V_{max}$ and a corresponding injection current $I_{max}$, and also a minimum absorption point $V_{min}$ of an absorption peak associated with the maximum absorption point $V_{max}$ and a corresponding injection current $I_{min}$; and determining an initial injection current ILD by adding a certain threshold value to $I_{min}$ or by subtracting the certain threshold value from $I_{max}$, so as to be located within the $I_{min}$; $I_{max}$ interval, away from the bounds $I_{min}$ and $I_{max}$.

8. The process for emitting a time signal within a wristwatch by an atomic oscillator as claimed in claim 7, which includes no feedback control of a frequency of the laser source.

9. The process for emitting a time signal within a wristwatch by an atomic oscillator as claimed in claim 7, wherein the second phase of priming the atomic oscillator comprises the following steps:

placing the atomic oscillator in closed-loop mode by returning the microwave signal received as output by the photodetector, for controlling the laser injection current;

adjusting the laser injection current to a predetermined value ILD;

verifying that a resonance phenomenon of the atomic oscillator is obtained in the laser beam output by the laser source; and in the case of non resonance of the atomic oscillator, slightly modifying the laser injection current ILD by a predefined increment, and repeating the step of slightly modifying the laser injection current ILD by a predefined increment, until a phenomenon of resonance is obtained.

10. The process for emitting a time signal within a wristwatch by an atomic oscillator as claimed in claim 7, which includes a step of adjusting a power of the laser source.

11. The process for emitting a time signal within a wristwatch by an atomic oscillator as claimed in claim 7, which includes a temperature feedback control of the atomic oscillator.

12. The process for emitting a time signal within a wristwatch by an atomic oscillator as claimed in claim 11, which includes operating the atomic oscillator at a temperature of 40° C. or below.

13. The process for emitting a time signal within a wristwatch by an atomic oscillator as claimed in claim 12, which includes operating the atomic oscillator at a temperature of 35° C. or below.

14. The process for emitting a time signal within a wristwatch by an atomic oscillator as claimed in claim 7, which includes measuring a temperature of the atomic oscillator, enabling a time signal emitted by the atomic oscillator to be corrected according to the temperature of the atomic oscillator.

* * * * *